United States Patent [19]

Yoshinaga et al.

[11] 4,125,345

[45] Nov. 14, 1978

[54] TURBO-FLUID DEVICE

[75] Inventors: Yoichi Yoshinaga, Minorimachi; Haruo Mishina, Ushikumachi; Kazuhiro Sunobe, Urawa, all of Japan

[73] Assignee: Hitachi, Ltd., Japan

[21] Appl. No.: 613,429

[22] Filed: Sep. 15, 1975

[30] Foreign Application Priority Data

| | | | |
|---|---|---|---|
| Sep. 20, 1974 | [JP] | Japan | 49-107795 |
| Jan. 6, 1975 | [JP] | Japan | 50-88 |
| Jun. 24, 1975 | [JP] | Japan | 50-76716 |

[51] Int. Cl.[2] ..... F04B 23/00

[52] U.S. Cl. ..... 417/243; 417/244; 415/179

[58] Field of Search ..... 417/243, 244, 246, 247, 417/423; 415/179

[56] References Cited

U.S. PATENT DOCUMENTS

| | | | |
|---|---|---|---|
| 1,088,585 | 2/1914 | Junkers | 415/179 |
| 1,668,099 | 5/1928 | Wintzer | 417/243 |
| 2,073,833 | 3/1937 | Bothezat | 415/179 |
| 2,236,853 | 4/1941 | Herzmark | 417/243 |
| 2,318,393 | 5/1943 | Honerkamp | 415/179 |
| 2,474,410 | 6/1949 | Aue | 415/179 |
| 2,619,279 | 11/1952 | Schaer | 417/179 |
| 2,814,254 | 11/1957 | Litzenberg | 417/350 |
| 2,925,954 | 2/1960 | Spillman et al. | 415/179 |
| 3,671,146 | 6/1972 | Alderson | 417/243 |

*Primary Examiner*—Carlton R. Croyle
*Assistant Examiner*—R. E. Gluck
*Attorney, Agent, or Firm*—Craig & Antonelli

[57] ABSTRACT

A turbo-fluid device in the form of a package, in which a heat exchanger used as a cooler for a turbo-compressor, desiccator, or turbo-refrigerator; or a heater for a turbo-generator is formed in an annular form, while there are housed in the interior of the annular heat exchanger an electric motor or generator, transmission, compressor and/or turbine, oil feed device and other accessories, thereby decreasing sound level and reducing the size and the weight of the device.

6 Claims, 24 Drawing Figures

TURBO-FLUID DEVICE

BACKGROUND OF THE INVENTION

This invention relates to turbo-fluid devices including a turbo-compressor, turbo-desiccator, turbo-refrigerator or a turbo-generator and the like.

The turbo-fluid device will be described by way of an example of a turbo-compressor.

The prior art turbo-compressor, as shown in FIG. 1, is of such an arrangement that a drive electric-motor 2 and an overdrive gear means 3 are rigidly mounted on a common base or support 1. In addition, a first compressor 4 is placed on one side of the overdrive gear means 3, while a second compressor 5 is placed on the other side of the overdrive gear means 3. An intermediate cooler 6 is interposed between the discharge side of the first compressor 4 and the intake side of the second compressor 5. In addition, a rear cooler 7 is placed on the discharge side of the second compressor 5. The rear cooler 7 is provided, in case the temperature of discharged air or other gases (This will be referred to as a gas, hereinafter) from the second compressor 5 is higher than that desired.

Gas is introduced through an intake port 8 in the first compressor 4, and then is accelerated by means of an impeller 9 of the first compressor 4. The flow of the gas thus accelerated is introduced into the intermediate cooler 6 through a diffuser 10 and a scroll 11, by which velocity energy of the aforesaid flow of gas is converted to pressure energy so that high gas pressure is established in the cooler 6. The gas is cooled in a piping 12 disposed within the intermediate cooler 6, during its flow through the cooler 6. The gas thus cooled is introduced by way of an intake pipe 13 through an intake port 15 into an impeller 14 of the second compressor 5. The gas is further compressed and accelerated by means of the impeller 14 and fed by way of a diffuser 16 and a scroll 17, producing a high pressure due to the conversion of its velocity energy into pressure energy. The gas having such a high pressure is then fed by way of a pipe 18 to the rear cooler 7, in which the gas is cooled, when passing through a piping 19 disposed within the rear cooler 7. The gas thus cooled is fed to a plant where it is used. Cooling water is supplied through an entrance port 20 to the piping 12 of the intermediate cooler and then discharged through an exit port 21. Likewise, cooling water is supplied through an entrance port 22 to a piping 19 in the rear cooler 17 and discharged through an exit port 23 outside.

The aforesaid first impeller 9 and second impeller 14 are driven through the medium of two gears 24, 25 in the overdrive gear means 3 by means of a drive electric-motor 2.

However, according to the arrangement of the aforesaid prior art turbo-compressor, the first compressor 4, second compressor 5 and overdrive gear means 3 are arranged in an integral system, while the intermediate cooler 6, rear cooler 7 and drive electric-motor 2 are mounted independently on the common base 1. Those components are coupled to each other only by means of joints or pipings, so that there may not be achieved a small-sized, lightened and complete-packaged arrangement for a compressor device. In addition, since the first compressor 4, second compressor 5, overdrive gear means 3 and drive electric-motor 2 are exposed to open air, sounds stemming from those components will be transmitted intact to the exterior, presenting a high level of sounds at the time of operation thereof.

SUMMARY OF THE INVENTION

It is an object of the present invention to provide a turbo-fluid device in the form of a complete package.

It is another object of the present invention to provide a turbo-fluid device which presents a low level of sounds.

It is a further object of the present invention to provide a turbo-fluid device which is compact in size and light in weight.

For attaining these and other objects of the present invention, there is provided a turbo-fluid device characterized in that there is provided an annular heat exchanger which cools or heats fluid discharged from the preceding stage impeller and charged into the succeeding stage impeller, or an annular heat exchanger which cools or heats fluid discharged from the final stage impeller, and there are housed in a columnar space defined in the annular heat exchanger a turbo-fluid means having at least two impellers, a drive electric-motor adapted to drive the aforesaid plurality of impellers or an electric generator driven by means of part of a plurality of impellers, transmission means interposed between the drive electric-motor or generator and a plurality of impellers and adapted to transmit power, with R.P.M. being changed, and an oil feeding means for supplying a lubricating oil to the drive electric-motor or generator and transmission means.

DESCRIPTION OF PREFERRED EMBODIMENTS

Figure 1:
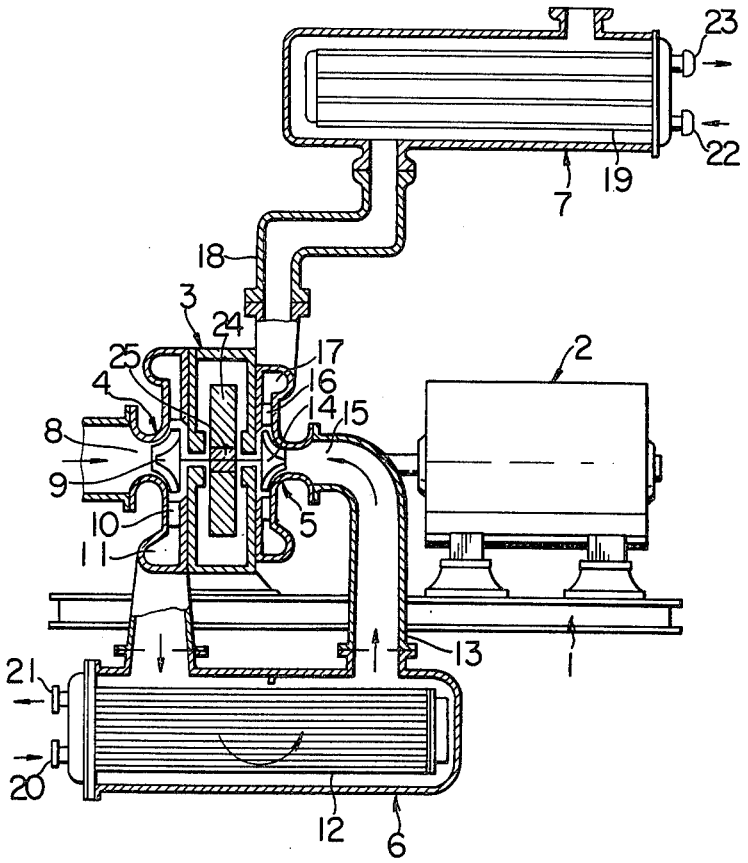
FIG. 1 PRIOR ART
FIG. 1 is a view illustrative of the prior art turbo-compressor device.
Figure 2:
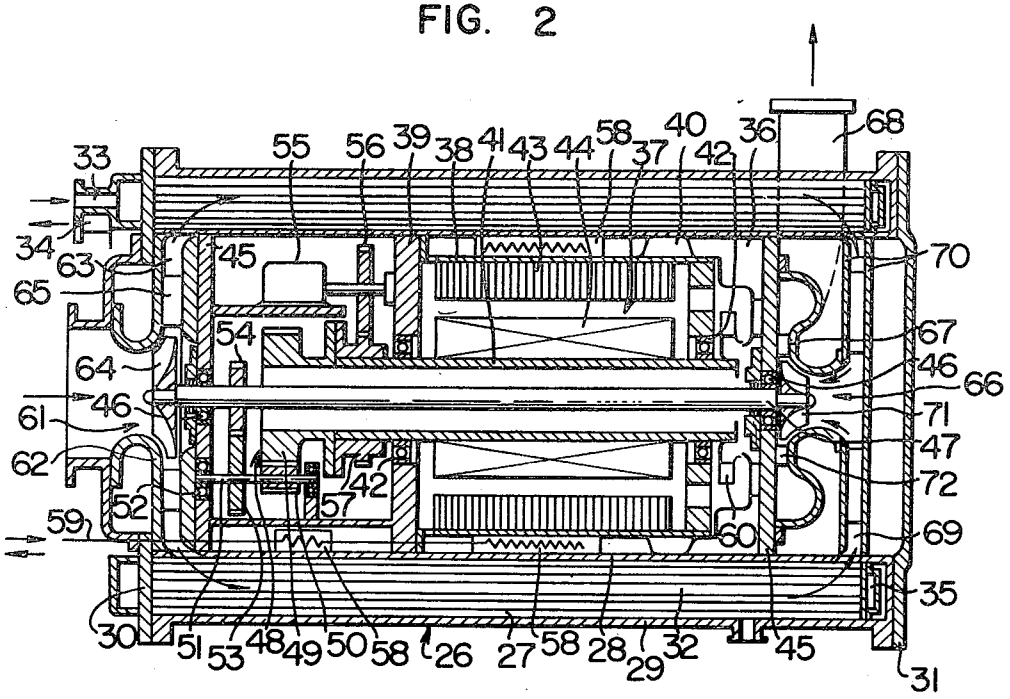
FIG. 2 is a cross-sectional view of one embodiment of the invention, in which the present invention is applied to a turbo-compressor device having two impellers.

FIG. 2 shows an embodiment of a turbo-compressor device having two impellers according to the present invention.

An intermediate cooler 26 is provided in the annular form. An annular space 27 is defined by an inner cylinder 28 and an outer cylinder 29 having different diameters and placed in concentric relation to each other, and two end plates 30, 31 closing the opposite ends of the annular space surrounded by the two cylinders 28, 29. A circular hole is defined in the end plate 30 in concentric relation to the outer diameter of the plate 30. Placed in the annular space 27 along the length of the annular space 27 are a plurality of heat conductive pipes 32. One end of the piping 32 is supported by the end plate 30, while half of pipes are communicated with a header 33 placed on the entrance side, and the remaining pipes are communicated with a header 34 on the exit side. The other end of piping is communicated with a water chamber 35 which is supported freely in the annular space.

A drive electric-motor 37 is housed in a columnar space 36 defined by the inner cylinder 28 of the intermediate cooler 26.

A housing 38 of the drive electric-motor 37 has one end secured to a disc-like supporting member 39, and another end supported within the inner cylinder 28 by means of a plurality of projections 40 formed on the circumferential surface of the housing 38 in a manner not to swing but movable in the direction of the length of inner cylinder 28. Disposed in the center of the housing 38 is a hollow, rotary shaft 41. The rotary shaft 41 is supported at two points, i.e., by means of the supporting member 39 and housing 38. Bearings 42 are interposed between the rotary shaft 41 and supporting member 39 as well as the end plate of housing 38. Secured to the inner surface of the housing 38 is a stator 43, while a rotor 44 is secured on the rotary shaft 41, with the stator 43 placed in opposing relation to the rotor 44.

A pair of supporting members 45 are secured to the inner cylinder 28 at portions adjacent to the opposite ends of the columnar space 36, respectively. A drive shaft 47 is supported through the medium of a bearings 46 which are fixed to the pair of supporting members 45 respectively. The drive shaft 47 extends through the rotary shaft 41 internally thereof.

An overdrive gear means 48 is provided between the drive shaft 47 and the rotary shaft 41. The overdrive gear means 48 consists of two sets of pinion and gear. The gear 49 is secured to the rotary shaft 41, while a pinion 50 meshing with the gear 49 is supported by a subsidiary shaft 51. The shaft 51 is supported through the medium of bearings 52 by the supporting member 45. A gear 53 is secured on the subsidiary shaft 51, while a pinion 54 meshing with the gear 53 is secured on the drive shaft 47.

An oil feed pump 55 is affixed to the supporting member 45. A gear 56 is secured on the drive shaft of the oil feed pump 55 and meshes with a gear 57 secured on the rotary shaft 41. Lubricating oil discharged from the oil feed pump 55 is fed via pipes (not shown) to the respective bearings and the respective pinions and gears of the overdrive gear means 48. The portion below the overdrive gear means 48 and, between the supporting member 39 and the supporting member 45, provides an oil sump, to which lubricating oil fed to the respective bearings is returned.

Heat exchangers 58 are placed on the outer circumference of the housing 38 of the drive electric-motor 37 and below the lubricating oil sump, respectively. Connected to the heat exchangers 58 is a pipe 59 communicated with the exterior, through which a cooling medium such as cooling water is circulated.

A fan 60 is secured to the right-hand end of the rotary shaft 41.

A first compressor 61 is placed in the left-end opening of the inner cylinder 28 of the intermediate cooler 26, closing the left-end opening. A casing 62 of the first compressor 61 is supported by the end plate 30 and supporting member 45. A discharge passage 63 defined by the casing 62 is communicated with the annular space 27 in the intermediate cooler 26 at its outer circumference. A first impeller 64 is located within the casing 62 and secured on the drive shaft 47. A diffuser 65 is placed within the discharge passage 63 adjacent to the periphery of the first impeller.

A second compressor 66 is located at the right end of the intermediate cooler 26 but internally of the end plate 31. A spiral casing 67 of the second compressor 66 is secured to the supporting member 45. A discharge pipe 68 connected to the spiral casing 67 extends through the intermediate cooler 26 and then projects outwardly thereof. Members 70 defining an intake passage 69 for the second compressor 66 is provided between the intake side of the spiral casing 67 and the inner cylinder 28, so that the annular space 27 in the hollow cooler 26 is communicated with the second compressor 66. A second impeller 71 is positioned within the spiral casing 67 and secured on the drive shaft 47. A diffuser 72 is positioned within the spiral casing 67 adjacent to the periphery of the second impeller 71.

The operation of the embodiment will now be described.

When the drive electric-motor 37 is energized, then the rotation of the rotary shaft 41 of the drive electric-motor 37 is transmitted to the drive shaft 47 by way of the gear 49, pinion 50, subsidiary shaft 51, gear 53, and pinion 54 of the overdrive gear means 48. The R.P.M. is increased according to the gear ratio of gear 49 and pinion 50, and gear 53 and pinion 54. As a result, the first impeller 64 and second impeller 71 are driven at a high speed, so that there takes place compression of gas.

Gas is introduced through the intake portion of the first compressor 61, with the speed of a gas flow increased by means of the first impeller 64, and then the gas is discharged. The gas discharged from the first impeller 64 passes through the discharge passage 63 and the diffuser 65 in which velocity energy of the gas flow is converted into pressure energy so that the pressure of the gas rises to an intermediate pressure, and then is fed into the annular space 27 in the intermediate cooler 26. Gas is cooled by means of cooling water through the piping 32 during the time, in which gas is flowing through the annular space 27 along the length of the piping 32. The cooled gas is introduced through the intake passage 69 into the second impeller 71, so that the flow speed of gas is increased. The velocity energy of the gas flow is again converted into pressure energy, when the gas passes through the diffuser 72 and spiral casing 6, and the gas under a high pressure is discharged through the discharge pipe 68.

When the drive electric-motor 37 rotates to compress gas, the oil feed pump 55 is driven. The oil feed pump 55 is driven by the medium of gears 56, 57. The oil feed pump 55 pumps up the lubricating oil from the oil sump, thereby feeding oil to the respective bearings and gears by way of pipes. Cooling water is fed by way of the pipe 59 from outside to the heat exchangers 58 to cool lubricating oil and the drive electric-motor 37. At the same time, cooling air is circulated by the fan 60 through the rotor 44 and stator 43 of the drive electric-motor 37 and the heat exchanger 58, thus improving cooling effect.

Figure 3:
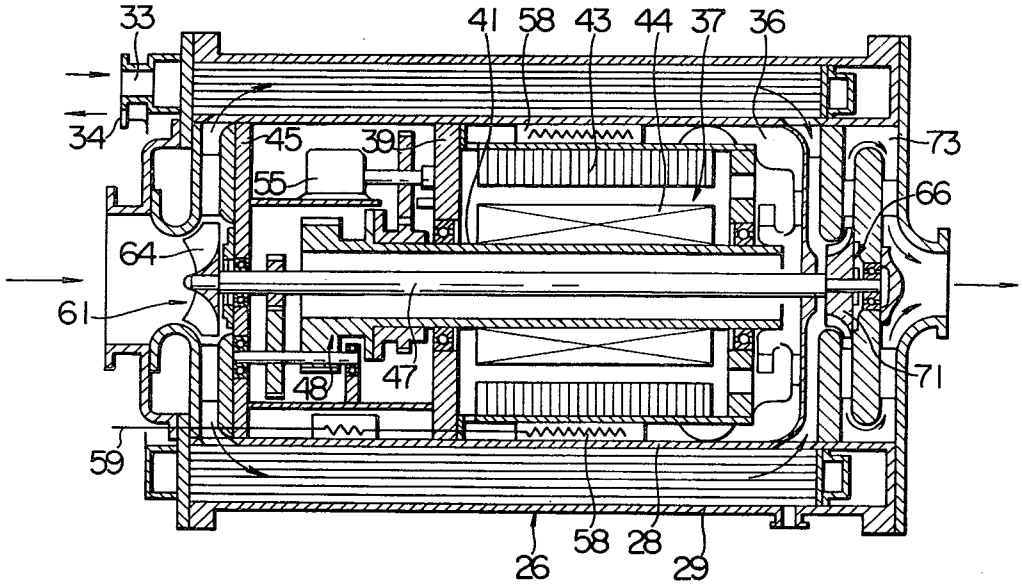
FIG. 3 is a cross-sectional view of another embodiment of the turbo-compressor device equipped with two impellers.

FIG. 3 shows another embodiment of a turbo-compressor device equipped with two impellers. In this respect, the spiral casing 67 of the second compressor 66 in the embodiment of FIG. 2 is replaced by a reverse flow passage 73. In this embodiment, gas discharged from the second compressor is taken out in the axial direction.

Figure 4:
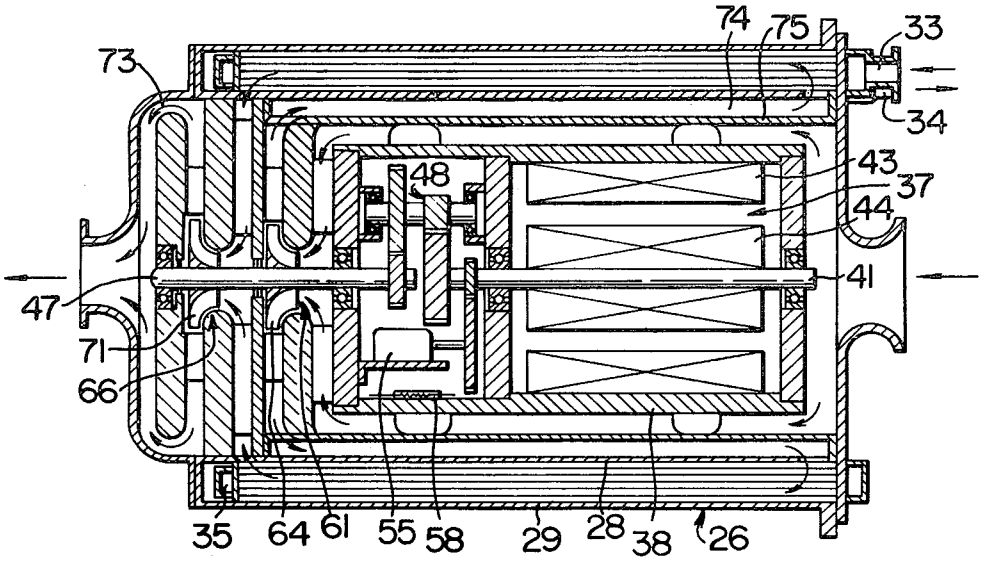
FIG. 4 is a cross-sectional view of a further embodiment of the turbo-compressor device having two impellers.

FIG. 4 shows a further embodiment of a turbo-compressor device equipped with two impellers. In this respect, the second compressor 66 in FIG. 2 is placed adjacent to the first compressor 61. In short, the first compressor 61 and the second compressor 66 are placed at an end of the intermediate cooler 26.

Due to the arrangement, in which the first and second compressors 61, 62 are placed at a same end of the cooler 26, there should be provided a passage 74, through which gas having an intermediate pressure and discharged from the first compressor 61 is introduced to the other side of the intermediate cooler 26. The passage 74 is formed by locating the cylindrical member 75 concentric with the inner cylinder 28 of the intermediate cooler 26.

Figure 5:
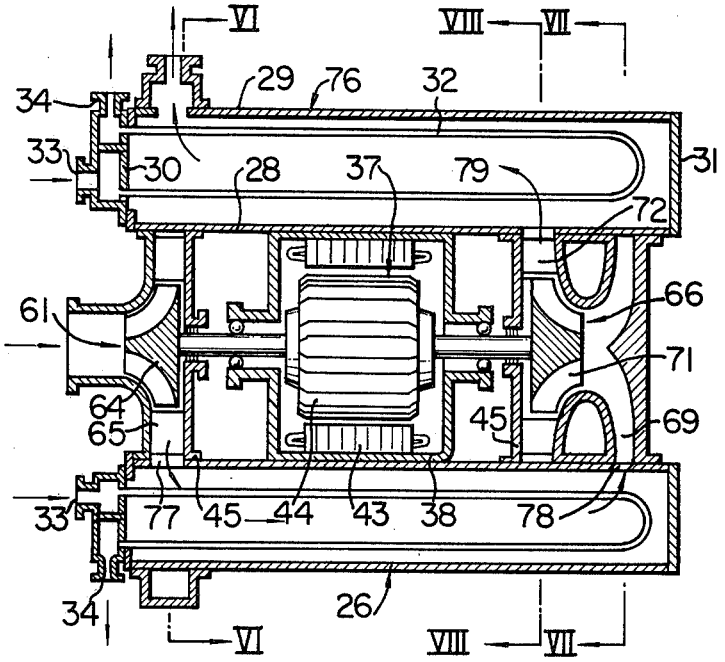
FIG. 5 is a cross-sectional view of a still further embodiment of the turbo-compressor device having two impellers.

FIG. 5 shows another embodiment of a turbo-compressor device equipped with two impellers, in which a rear cooler 76 is provided integral with the intermediate cooler 26. In this embodiment, the oil feed pump 55 and heat exchanger 58 are not shown. In addition, the overdrive gear means 48 is not provided, while the means 48 may be provided, as required.

Figure 6:
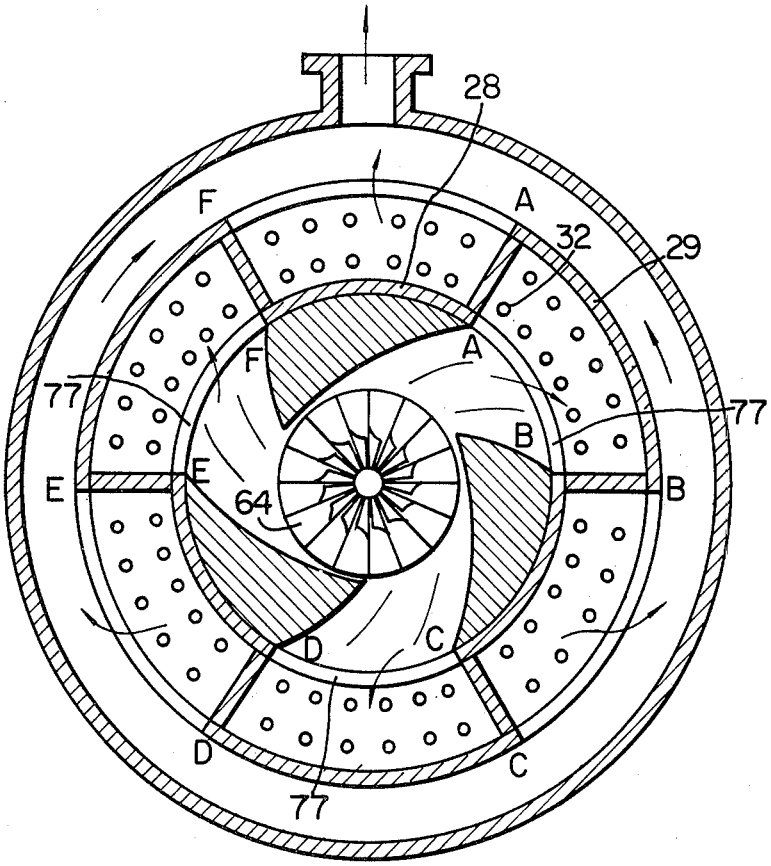
FIG. 6 is a cross-sectional view taken along the line VI — VI of FIG. 5.
Figure 7:
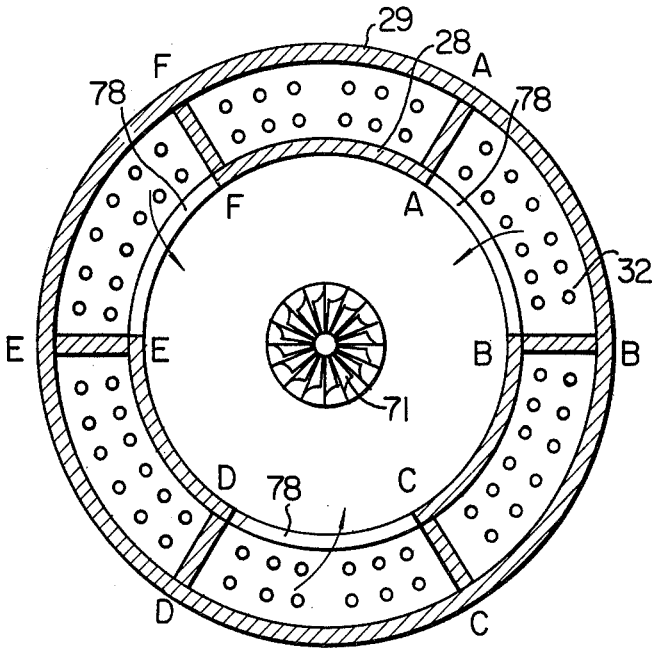
FIG. 7 is a cross-sectional view taken along the line VII — VII of FIG. 5.
Figure 8:
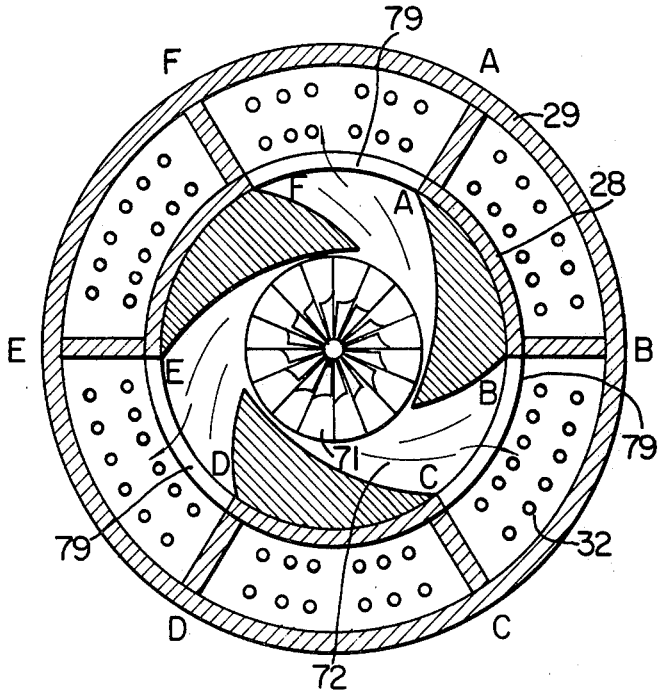
FIG. 8 is a cross-sectional view taken along the line VIII — VIII of FIG. 5.
Figure 9:
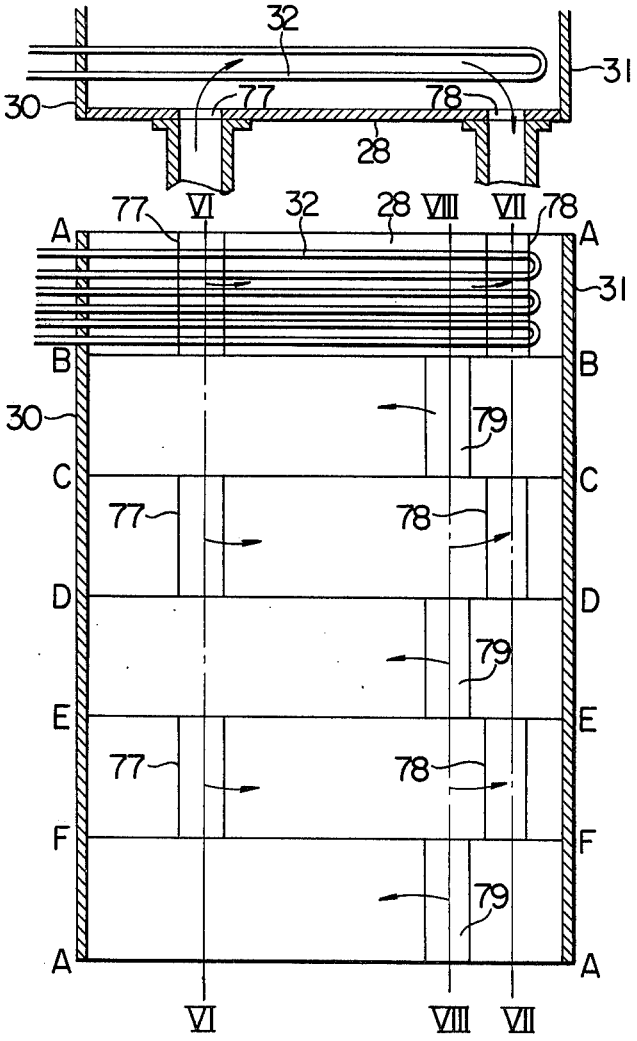
FIG. 9 is an expanded view taken along the inner cylinder of the embodiment of FIGS. 5 to 8.

FIGS. 6 to 9 are shown for better understanding of the embodiment of FIG. 5. FIGS. 6, 7 and 8 are cross-sectional views taken along the line VI — VI, line VII—VII and line VIII—VIII of FIG. 5 or FIG. 9, respectively. FIG. 9 shows an expanded view taken along the inner cylinder 28. As shown, an annular space in the annular cooler, in which the intermediate cooler is integral with the rear cooler, is divided along the circumference thereof into six compartments by means of six partition walls AA, BB, CC, DD, EE, and FF each extending in the radial direction. 'U' shaped pipes 32 are placed within the respective compartments, ABBA, BCCB, CDDC, DEED, EFFE, and FAAF, along the length of the respective compartments. The pipes 32 are secured to the end plate 30 by expanding the adjacent end thereof, with one end thereof connected to the entrance header 33 and with the other end thereof connected to the exit header 34, respectively. The aforesaid compartments ABBA, CDDC, EFFE are used as an intermediate cooler 26, while the compartments BCCB, DEED, FAAF are used as a rear cooler 76.

Provided in the positions of three compartments which constitute the intermediate cooler 26 in the inner cylinder 28 are intake openings 77 through which gas from the first compressor 61 is introduced into the intermediate cooler 26, and an outflow openings 78, through which gas from the intermediate cooler 26 is introduced into the second compressor 66. In addition, intake openings 79 are provided in the positions of the three compartments of the rear cooler 76, through which gas from the second compressor 66 is introduced into the rear cooler 76.

Figure 10:
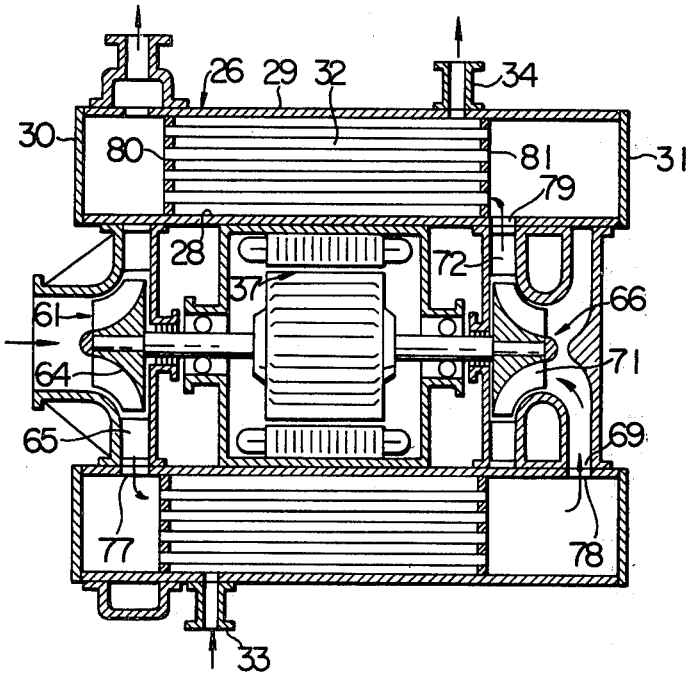
FIG. 10 is a cross-sectional view of a yet further embodiment of the turbo-compressor device equipped with two impellers.

FIG. 10 shows a further embodiment of a turbo-compressor device having two impellers, in which gas passes through the pipes 32, while cooling water passes outside of the pipes 32.

Figure 11:
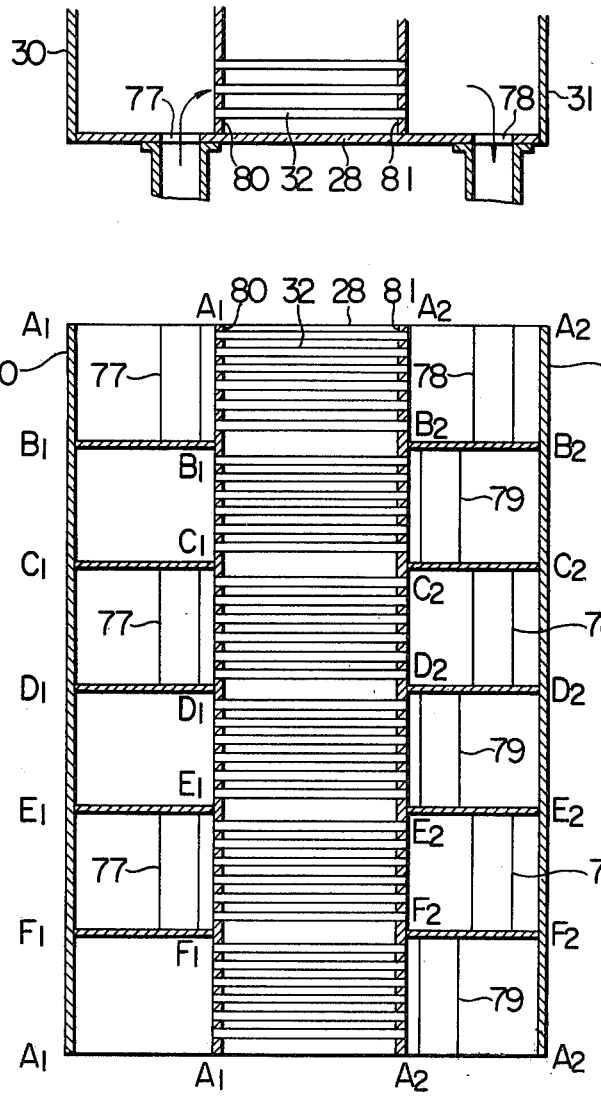
FIG. 11 is an expanded view taken along the inner cylinder of FIG. 10.

FIG. 11 shows an expanded view taken along the inner cylinder 28. FIG. 11 shows pipes 32 in a specific compartment for better understanding.

Disposed in the annular space in its lengthwise direction are pipes 32, the opposite ends thereof being secured to the pipe plates 80, 81 by expanding. An annular space defined between the end plate 30 and pipe plate 80 is divided into six divisions in the circumferential direction by means of 6 partition walls $\overline{A_1A_1}$, $\overline{B_1B_1}$, $\overline{C_1C_1}$, $\overline{D_1D_1}$, $\overline{E_1E_1}$, $\overline{F_1F_1}$ which extend in the radial direction. On the other hand, an annular space defined between the end plate 31 and the pipe plate 81 is divided in the radial direction by means of six partition walls $\overline{A_2A_2}$, $\overline{B_2B_2}$, $\overline{C_2C_2}$, $\overline{D_2D_2}$, $\overline{E_2E_2}$, $\overline{F_2F_2}$ which extend in the radial direction. Used as an intermediate cooler are compartments $A_1B_1B_1A_1$ and $A_2B_2B_2A_2$ and pipes 32 connecting therewith, compartments $C_1D_1D_1C_1$, $C_2D_2D_2C_2$ and pipes 32 connecting therewith, and compartments $E_1F_1F_1E_1$, $E_2F_2F_2E_2$ and pipes 32 connecting therewith.

Used as a rear cooler are compartments $B_1C_1C_1B_1$, $B_2C_2C_2B_2$ and pipes 32 connecting therewith, compartments $D_1E_1E_1D_1$, $D_2E_2E_2D_2$ and pipes 32 connecting therewith, and compartments $F_1A_1A_1F_1$, $F_2A_2A_2F_2$ and pipes 32 connecting therewith.

In the positions of the compartments $A_1B_1B_1A_1$, $C_1D_1D_1C_1$ and $E_1F_1F_1E_1$ in the inner cylinder 28, there are provided intake ports 77 for gas. In the positions of the compartments $A_2B_2B_2A_2$, $C_2D_2D_2C_2$ and $E_2F_2$-$F_2E_2$, there are provided intake ports 78 for gas, respectively. In the positions of the compartments $B_2C_2C_2B_2$, $D_2E_2E_2D_2$, $F_2A_2A_2F_2$, there are provided intake ports 79 for gas.

Figure 12:
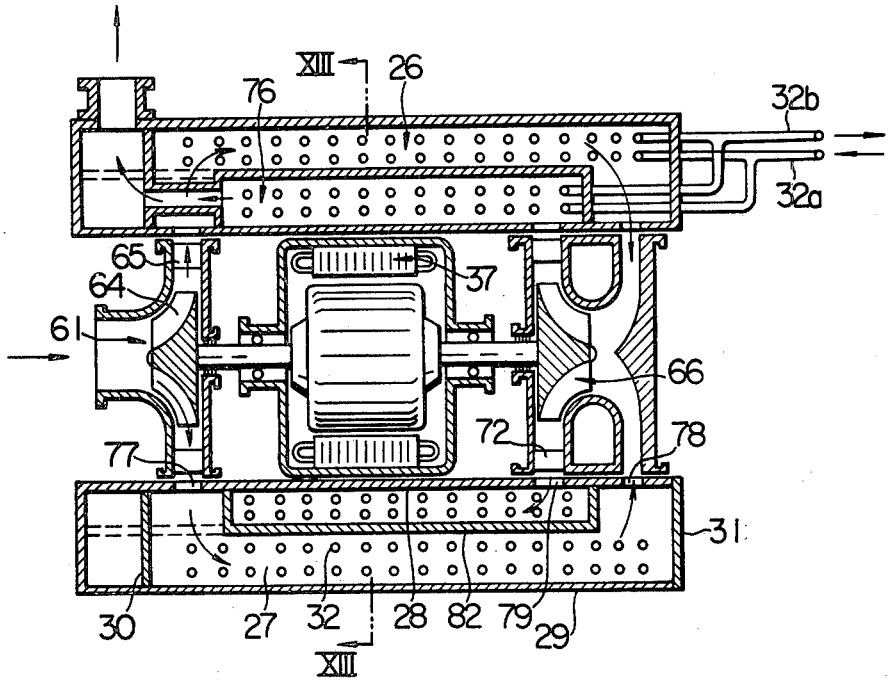
FIG. 12 is a cross-sectional view of a yet further embodiment of the turbo-compressor device equipped with two impellers.

FIG. 12 shows another embodiment of a turbo-compressor device equipped with two impellers. The annular space 27 is divided into two compartments by means of an concentric intermediate cylinder 82, while the heat conductive pipe 32 (corresponding to pipes 32) is arranged in the form of a coil.

Figure 13:
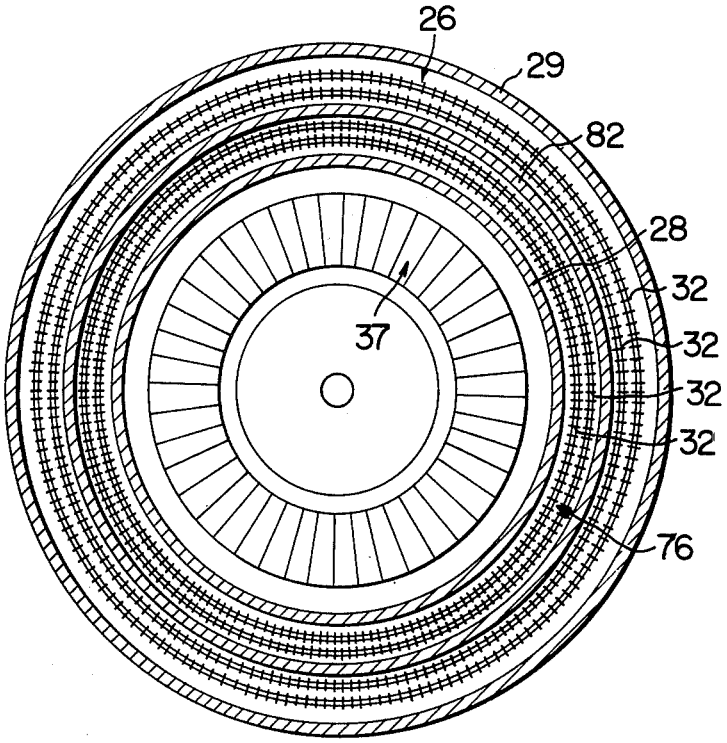
FIG. 13 is a cross-sectional view taken along the line XIII — XIII of FIG. 12.

FIG. 13 is a cross-sectional view, taken along the line XIII — XIII of FIG. 12, illustrating in more detail two annular compartments divided. The outer annular compartment is used as an intermediate cooler 26 for cooling gas discharged from the first compressor 61, while the inner annular compartment is used as a rear cooler 76 for cooling gas discharged from the second compressor 66.

One end of the heat conductive pipe 32 is connected to a supply source for cooling water, so that cooling water is supplied from the end 32*a* and the other end of the pipe 32*b* is connected to discharge pipe. The inner annular compartment may be used as an intermediate cooler 26, while the outer annular compartment may be used as a rear cooler 76.

Figure 14:
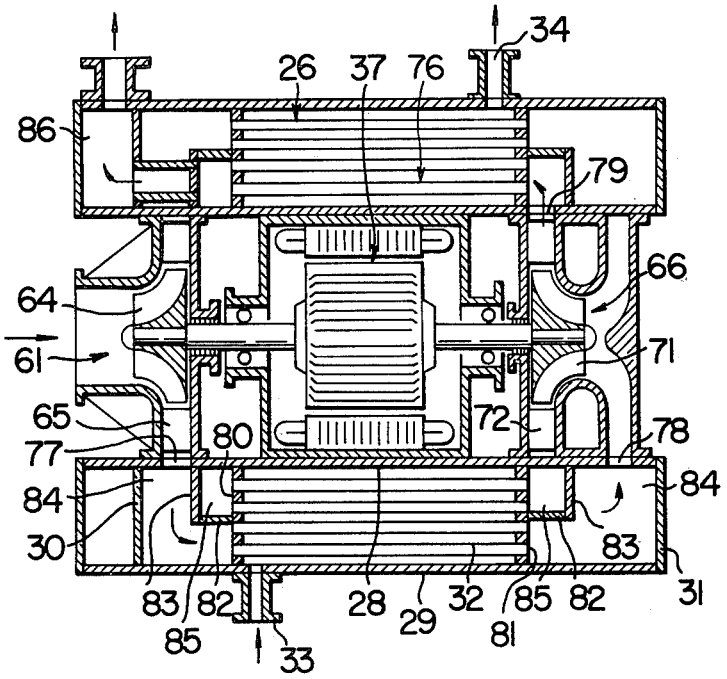
FIG. 14 is a cross-sectional view of a further embodiment of the turbo-compressor device having two impellers.

FIG. 14 shows a still another embodiment of a turbo-compressor device having two impellers, in which the annular space 27 is divided into two annular divisions and gas may pass through the pipes 32.

Disposed in the annular space 27 in the lengthwise direction thereof are pipes 32, the both ends thereof being secured to pipe plates 80, 81 by expanding, respectively. The annular space defined between the end plate 30 and the pipe plate 80 is divided into two spaces 84, 85 by means of the intermediate cylinder 82 having one end secured to the pipe plate 80 as well as by the partition wall 83 continuous therewith, the aforesaid intermediate cylinder 82 being concentric with the inner cylinder 28 and outer cylinder 29. On the other hand, the arrangement of an annular space defined between the end plate 31 and the pipe plate 81 is the same as the preceeding annular space. The space 84 and pipes 32 connecting therewith constitute the intermediate cooler 26, while the space 85 and pipes 32 connecting therewith constitute the rear cooler 76.

A discharge collective chamber 86 is communicated with the exit of a space 85. In this example, the space 84 and pipes connecting therewith may be used as an intermediate cooler 26, while the space 85 and pipes connecting therewith may be used as a rear cooler 76.

Figure 15:
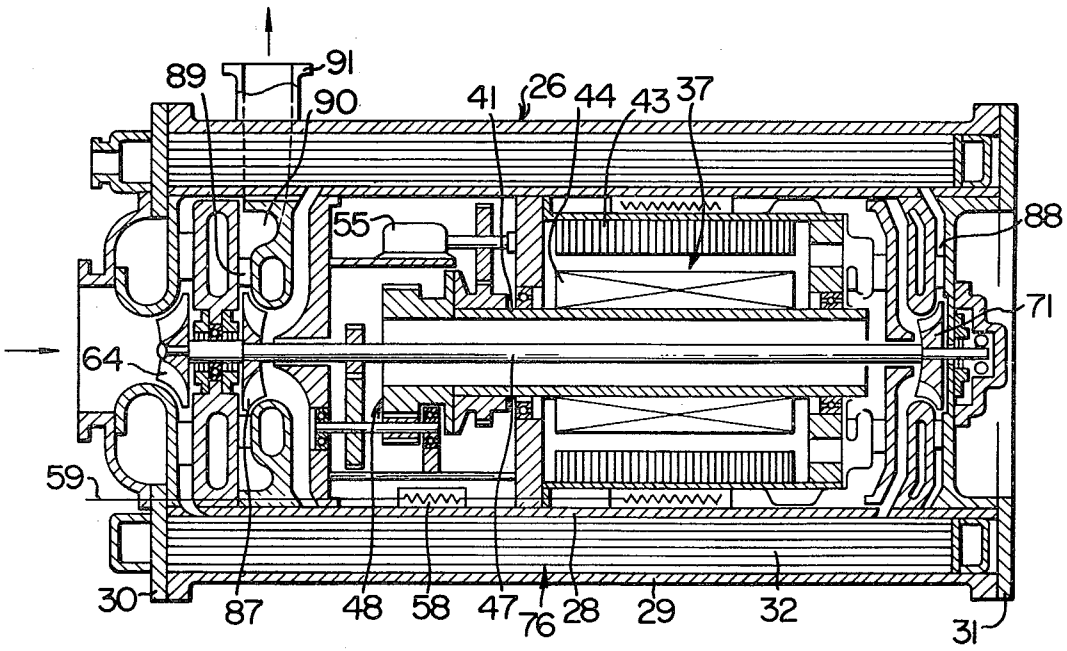
FIG. 15 is a cross-sectional view of a further embodiment of the turbo-compressor device equipped with three impellers.

FIG. 15 shows a still further embodiment of a turbo-compressor device equipped with three impellers, in which two impeller are placed at one end, while a single impeller is placed at the other end of a cooler 26.

A third impeller 87 is provided adjacent to the first impeller 64 in the embodiment of FIG. 2. The third impeller 87 is secured on the drive shaft 47. The spiral casing 67 of the second compressor 66, and discharge pipe 68 are removed, and an outflow passage 88 is provided. Placed on the discharge side of the third impeller 87 in a continuous manner are diffuser 89, scroll 90 and discharge pipe 91. Those components are of the same type as those given in the second compressor in the example of FIG. 2.

The intermediate cooler in this embodiment may be of the same construction as those shown in FIGS. 5, 6, 7, 8, and 9. In this case, gas which has passed through the rear cooler is introduced into the third impeller 87, and the rear cooler shown in the embodiments of FIGS. 5 to 9 is used as an intermediate cooler in this embodiment. The rear cooler is not provided in this embodiment.

Figure 16:
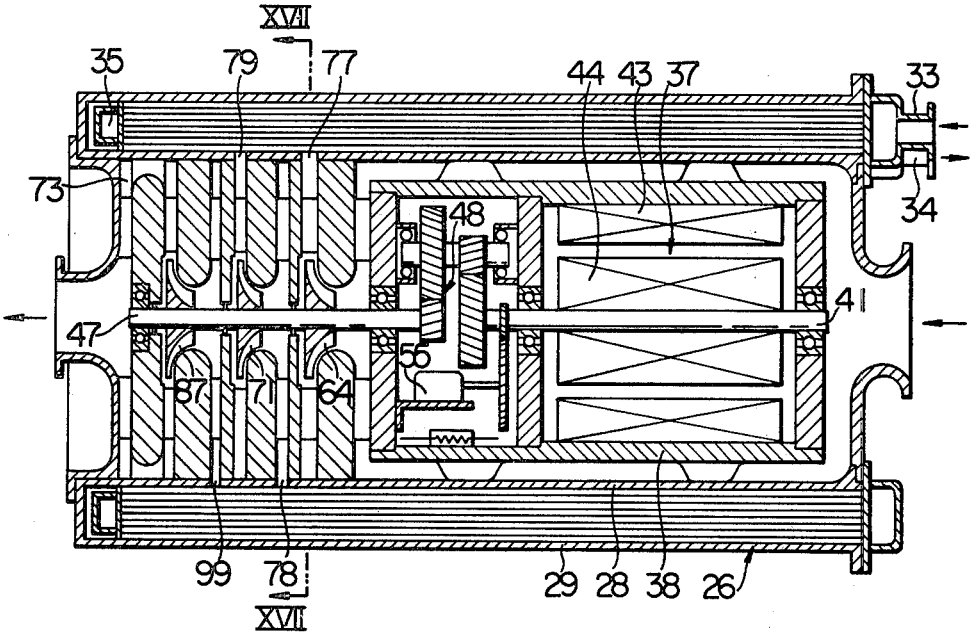
FIG. 16 is a cross-sectional view of a further embodiment of the turbo-compressor device equipped with three impellers.

FIG. 16 shows a further embodiment of the turbo-compressor device equipped with three impellers, in which a third impeller 87 is placed adjacent to the second impeller 71 as given in the example of FIG. 4. Stated otherwise, three impellers are provided adjacent to each other.

Figure 17:
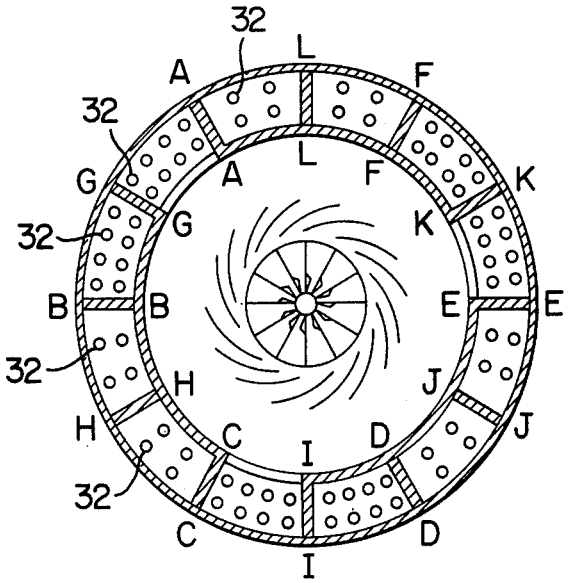
FIG. 17 is a cross-sectional view taken along the line XVII — XVII of FIG. 16.
Figure 18:
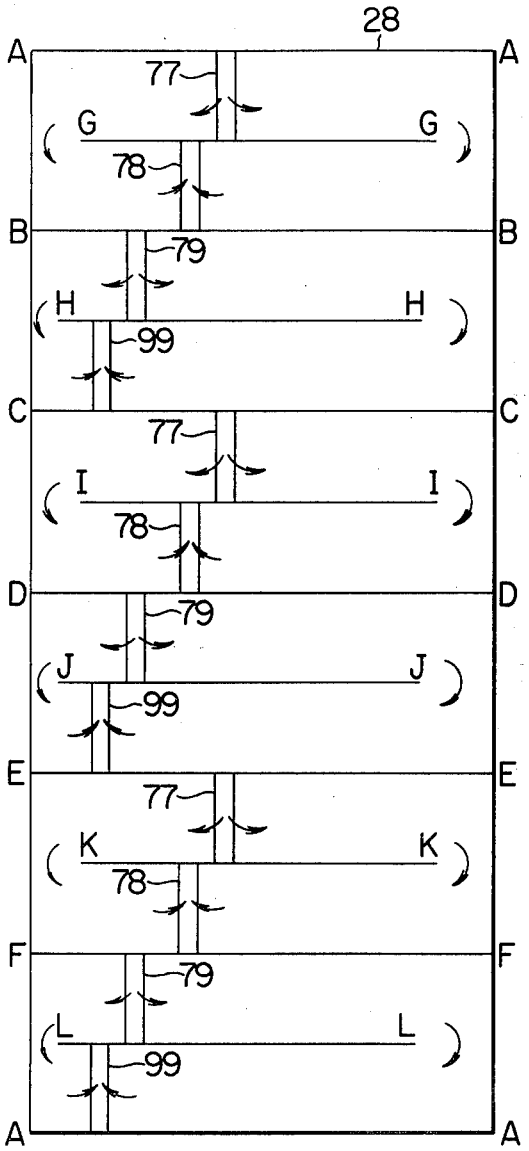
FIG. 18 is an expanded view taken along an inner cylinder of the embodiment of FIGS. 16 and 17.

FIGS. 17 and 18 show the construction of the intermediate cooler used in the embodiment of FIG. 16. FIG. 17 is a cross-sectional view taken along the line XVII — XVII, and FIG. 18 is an expanded view taken along the inner cylinder 28.

As shown in FIG. 17 and in FIG. 18, there are provided in the annular space 27 six partition walls $\overline{AA}$, $\overline{BB}$, $\overline{CC}$, $\overline{DD}$, $\overline{EE}$, $\overline{FF}$ extending in the radial direction, so that the annular space 27 is divided into six compartments along its circumference. Provided in each of compartments are flow guide plates $\overline{GG}$, $\overline{HH}$, $\overline{II}$, $\overline{JJ}$, $\overline{KK}$, $\overline{LL}$. The spaces partitioned by means of those guide plates are communicated with each other at the opposite ends of each space. Three compartments ABBA, CDDC, EFFE are used as an intermediate cooler which cools gas to be introduced into the second impeller 71, while the other three compartments BCCB, DEED, FAAF are used as an intermediate cooler which cools gas discharged from the second impeller 71 to be introduced into the third impeller 87. Provided in the inner cylinder 28 are intake ports 77, through which gas discharged from the first impeller 64 flows into the three compartments constituting an intermediate cooler, exit ports 78, through which gas from the above compartments flows into the second impeller 71, intake ports 79, through which gas discharged from the second impeller 71 flows into three compartments constituting the intermediate cooler, and exit ports 99, through which gas from those compartments flows into the third impeller 87.

Figure 19:
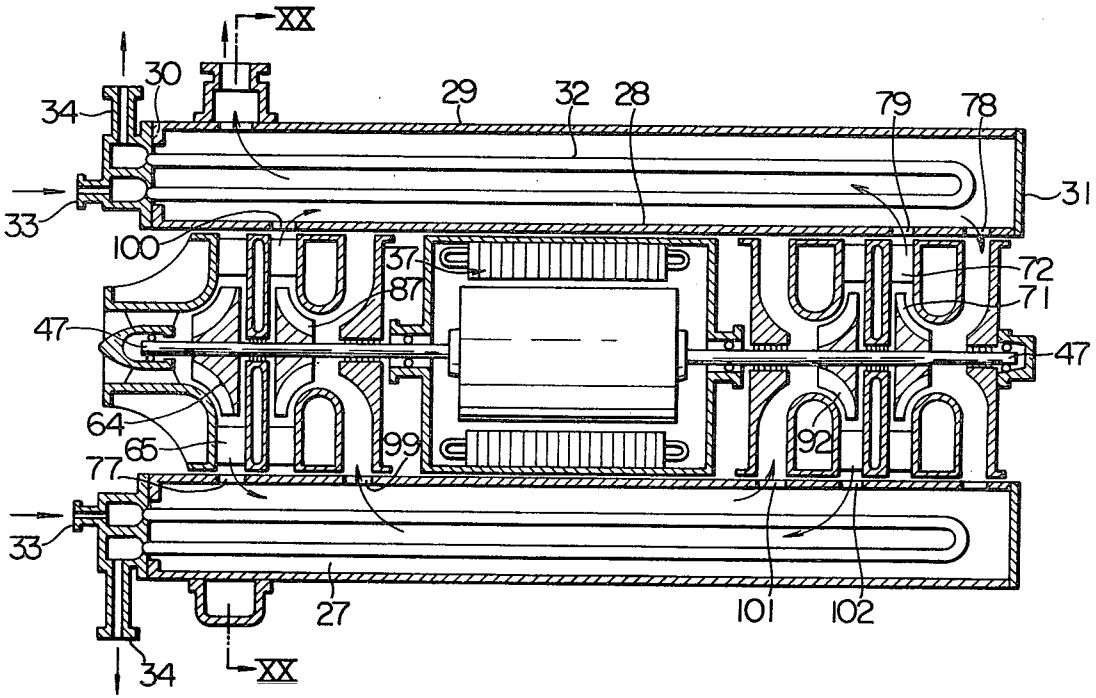
FIG. 19 is a cross-sectional view of a further embodiment of the turbo-compressor device having four impellers.

FIG. 19 shows an embodiment of a turbo-compressor device equipped with four impellers, and two impellers are each provided on the opposite ends.

Figure 20:
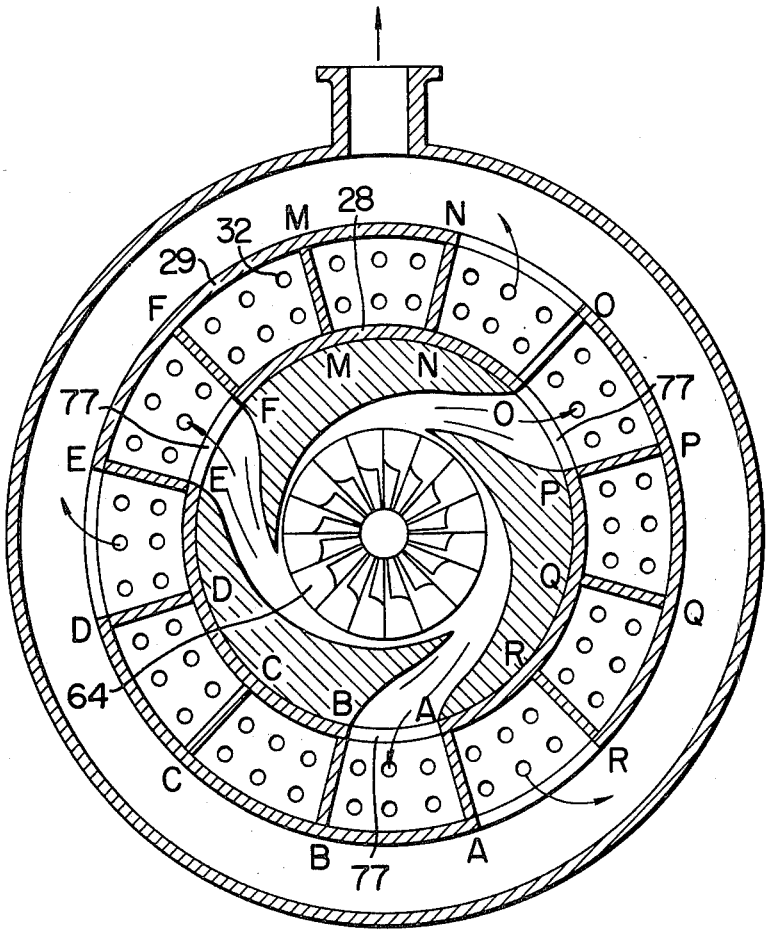
FIG. 20 is a cross-sectional view taken along the line XX — XX of FIG. 19.

The fourth impeller 92 is positioned adjacent to the second impeller 71 and secured on the drive shaft 47. FIG. 20 shows a cross sectional view taken along the line XX — XX of FIG. 19. As shown, in the annular space defined by the inner cylinder 28, outer cylinder 29 and end plates 30, 31, there are provided twelve partition walls $\overline{AA}$, $\overline{BB}$, $\overline{CC}$, $\overline{DD}$, $\overline{EE}$, $\overline{FF}$, $\overline{MM}$, $\overline{NN}$, $\overline{OO}$, $\overline{PP}$, $\overline{QQ}$, $\overline{RR}$ extending in the radial direction, dividing the annular space into twelve compartments along its circumference. Disposed in each of those compartments are pipes 32 which extend in the lengthwise direction of the compartments. The compartments ABBA, EFFE, OPPO are used as an intermediate cooler which cools gas to be introduced into the second impeller 71, while the compartments BCCB, FMMF, PQQP are used as an intermediate cooler which cools gas discharged from the second impeller 71 to be introduced into the third impeller 87. The compartments CDDC, MNNM, QRRQ are used as an intermediate cooler which cools gas discharged from the third impeller 87 to be introduced into the fourth impeller 92. The compartments DEED, NOON, RAAR are used as a rear cooler which cools gas discharged from the fourth impeller 92.

Provided in the inner cylinder 28 are intake ports 77, through which gas discharged from the first impeller 64 flows into three compartments constituting an intermediate cooler, exit ports 78, through which gas from those compartments flows into the second impeller 71, intake ports 79, through which gas discharged from the second impeller 71 flows into other three compartments constituting an intermediate cooler, exit ports 99, through which gas discharged from those compartments flows into the third impeller 87, intake ports 100, through which gas discharged from the third impeller 87 flows into still other compartments constituting an intermediate cooler, exit ports 101, through which gas from those compartments flows into the fourth impeller 92, and intake ports 102, through which gas from the forth impeller 92 flows into the remaining three compartments constituting a rear cooler.

Figure 21:
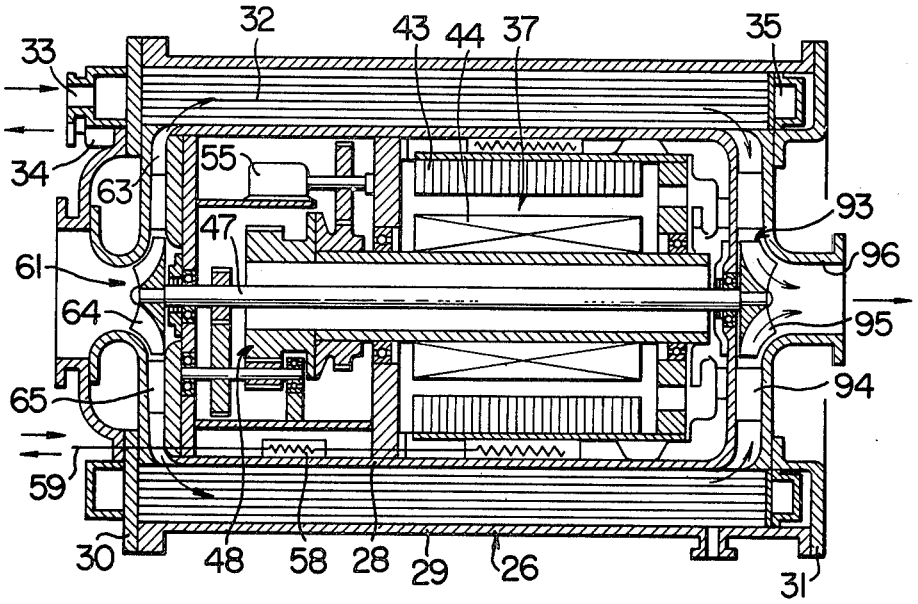
FIG. 21 is a cross-sectional view of an embodiment of a turbo-refrigerator device.

FIG. 21 shows an embodiment of a turbo-refrigerator. In this embodiment, an expansion turbine 93 is used in place of the second compressor 66 of FIG. 2. The expansion turbine 93 consists of a nozzle blade 94, turbine impeller 95 and discharge pipe 96.

The principle of the turbo-refrigerator is such that a compressor is driven by means of an electric motor to produce a high pressure gas, which in turn is cooled by a cooler to produce a pressurized low-temperature gas, which is then introduced into the expansion turbine to be expanded, thereby obtaining a low-temperature gas. The power produced by the expansion turbine is used as a part of power to drive the compressor.

In operation of the turbo-refrigerator, the drive shaft 47 is driven through the medium of the overdrive gear means 48 by means of the drive electric-motor 37. As a result, the first impeller 64 and turbine impeller 95 are rotated. The rotation of the first impeller 64 brings about suction of gas, and then gas flow is accelerated by means of the first impeller 64, discharged therefrom, then passed the diffuser 65, so that velocity energy of the gas flow is converted into pressure energy presenting a high pressure gas. The high pressure gas then flows through the discharge passage 63 into the intermediate cooler 26. In this cooler, gas is cooled by means of pipes 32, while the gas is flowing through the pipes 32 in contact therewith. The gas thus cooled flows through the nozzle blade 94 and is expanded into a high speed swirl flow, then is introduced into the turbine impeller 95. In the turbine impeller 95, gas is expanded to a further extent, so that energy is imparted to the turbine impeller 95, while the gas itself loses energy to lower its temperature and is then discharged through the discharge pipe 96. The low temperature gas thus produced is utilized for cooling.

Figure 22:
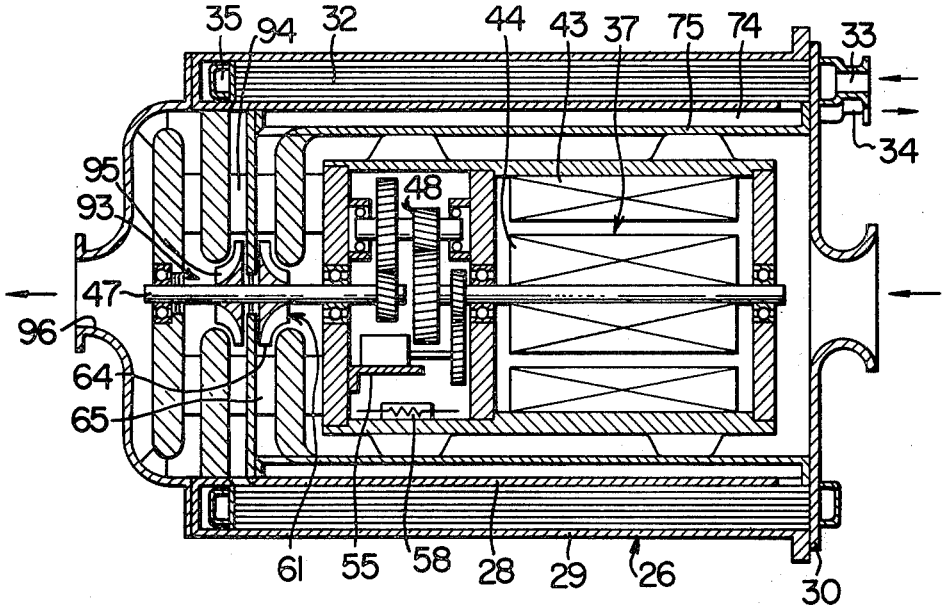
FIG. 22 is a cross-sectional view of another embodiment of a turbo-refrigerator device.

FIG. 22 shows another embodiment of a turbo-refrigerator, in which the first compressor 61 and expansion turbine 93 are placed adjacent to each other. In this example, the arrangement is the same as that of FIG. 4, except that an expansion turbine 93 is provided in place of the second compressor 66.

Figure 23:
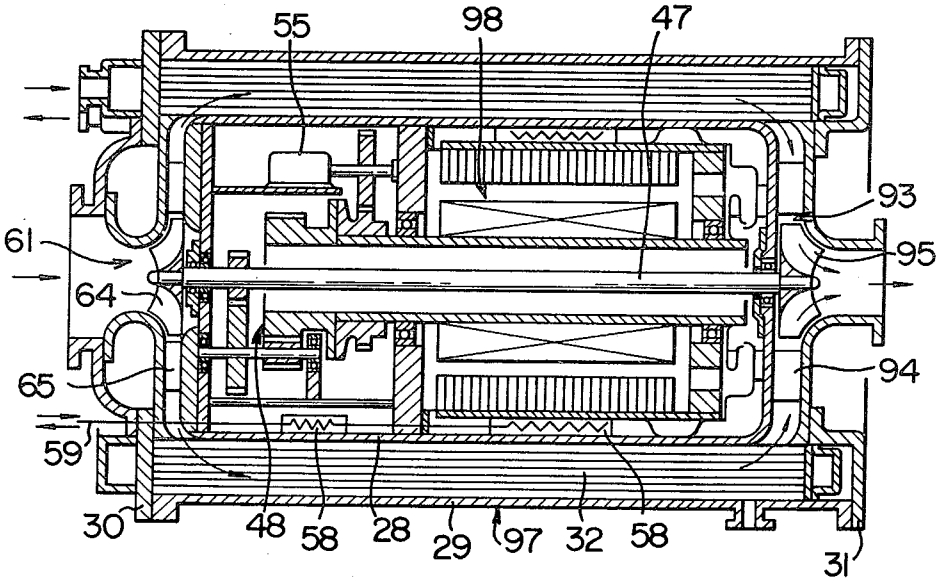
FIG. 23 is a cross-sectional view of an embodiment of a turbo-electric generator device.

FIG. 23 shows an embodiment of a turbo-electric generator. The arrangement is the same as that of the turbo-refrigerator of FIG. 21, in which an intermediate cooler 26 is used as a heating-heat exchanger 97, and generator 98 is used in place of the drive electric-motor 37. In this embodiment, the turbine impeller 95 serves as a driving component, so that the overdrive gear means 48 serves as an decelerating gear means. The generator 98 which may be used as an electric-motor is well suited for this embodiment. The principle of the turbo-generator is such that a high temperature gas which has been compressed in a compressor is heated in the heating-heat exchanger, and then gas whose temperature and pressure have been thus raised, is expanded to produce power. Since power of a turbine output is greater than power required for driving a compressor, so that part of the turbine output is consumed for driving the compressor, while the remaining power is available for driving the generator and then taken out as an effective output. More particularly, in FIG. 23, the generator 98 is used at the starting of operation, or the drive shaft 47 is driven by means of another electric-motor, thereby rotating the impeller 64 of the first compressor 61. With an increase in R.P.M., the gas thus compressed is fed to the heating-heat exchanger 97. A high temperature fluid such as a high temperature cooling gas from an atomic reactor or a high temperature exhaust gas from a chemical plant is introduced into the heating-heat exchanger 97, thereby heating a high temperature gas being fed from the aforesaid first compressor 61 to impart energy thereto. A high temperature gas which has been imparted energy through the heat-exchanger flows into the turbine impeller 95 and is expanded therein, thereby producing power. The output of the turbine impeller 95 is transmitted through the medium of the drive shaft 47 to the first impeller 64 as well as to the transmission gear means 48, while part of the aforesaid power is consumed for driving the first impeller 64, with the remaining part of power consumed for driving the generator 98 as an effective output.

Figure 24:
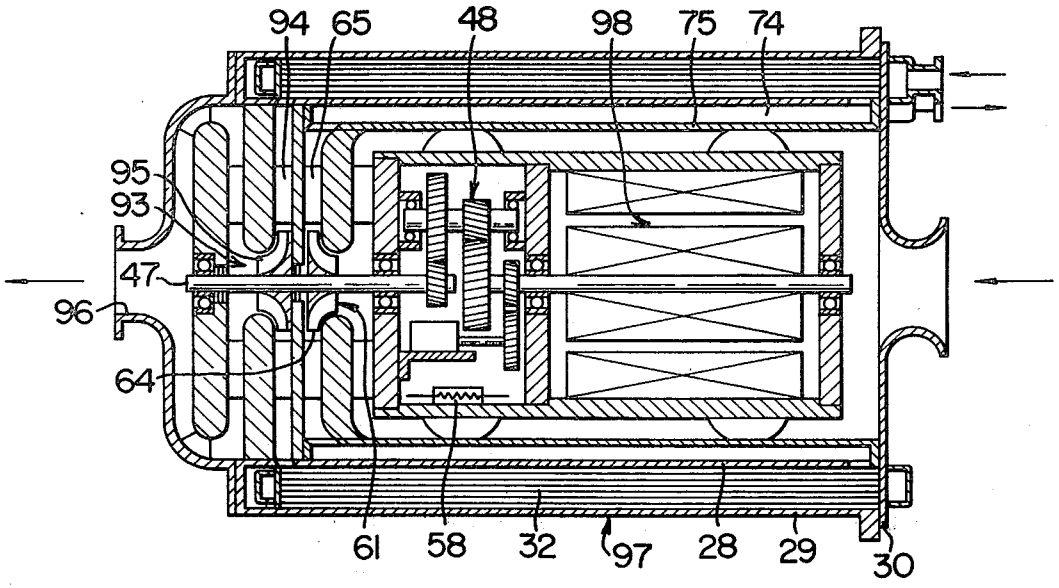
FIG. 24 is a cross-sectional view of another embodiment of the turbo-electric generator device.

FIG. 24 shows another embodiment of a turbo-generator, in which the first compressor 61 and turbine 93 are placed adjacent to each other.

The arrangement in this embodiment is the same as that of FIG. 4, except that a turbine 93 is placed in place of the second compressor 66, and an intermediate cooler is used as a heating-heat exchanger 97, and in addition, the overdrive gear means is used as a decelerating gear means 48.

ADVANTAGES OF THE INVENTION

The present invention may provide a turbo-fluid device in the form of a complete package, by providing an annular cooler or heat exchanger such as a heating-heat exchanger, and then a drive electric-motor, generator, transmission, compressor, turbine, oil feed means and the like are housed in the internal columnar space of the annular heat exchanger.

The sound sources such as a drive electric-motor, generator, transmission gear, compressor, turbine, oil feed means and the like are encompassed with the annular heat exchanger, so that sounds which are to be propagated to the exterior may be reduced in their level, so that there may be provided a turbo-fluid device producing a low level of sounds.

Since the heat exchanger is formed in an annular form, and equipments are housed in the columnar space therein, the space required for piping is unnecessary, and so the fluid device may be rendered compact in size and lighter in weight, as compared with the fluid device presenting the same flow rate or capacity.

What is claimed is:

1. Turbo-fluid apparatus comprising:

a first impeller, a second impeller, an electric rotary machine drivingly connected with said impellers, and a heat exchanger for accommodating heat exchange between gases discharged from at least one of said impellers and a further heat exchange medium, wherein said heat exchanger is formed in an annular shape to define a columnar space therein, and wherein said impellers and said electric rotary machine are disposed within said columnar space, whereby structure of said heat exchanger serves to reduce noise transmission to the surrounding area from the impellers and electric rotary machine while also accommodating a compact construction of the turbo-fluid apparatus, wherein said electric rotary machine is a two stage compressor with one of said impellers for each stage, and wherein said heat exchanger includes an intermediate cooler for cooling gases discharged from said first impeller prior to passage of said gas to said second impeller, wherein said heat exchanger includes a rear cooler for cooling gas discharged from said second impeller, and wherein said intermediate and rear coolers are arranged concentric to one another.

2. Apparatus according to claim 1, wherein said heat exchanger is formed with a plurality of heat exchanging compartments, wherein part of a plurality of compartments serves as the intermediate cooler, while the remaining compartments serve as the rear cooler which cools gas discharged from an impeller in the final stage.

3. Apparatus according to claim 2, wherein a group of heat conductive pipes are provided in each of said compartments along the length thereof.

4. Apparatus according to claim 1, wherein said intermediate and rear coolers are the same length in the axial direction of said apparatus.

5. Apparatus according to claim 1, wherein said intermediate cooler extends further than said rear cooler in the axial direction of said apparatus.

6. Apparatus according to claim 1, wherein each of the first and second impellers are fluidly connected to the heat exchanger through a plurality of passages disposed around the periphery of the respective impellers so that the compressed fluid discharged from a respective impeller flows through such passages into the heat exchanger without being collected in one position about the periphery of the respective impellers.

* * * * *